US009668928B2

(12) United States Patent
Paul et al.

(10) Patent No.: US 9,668,928 B2
(45) Date of Patent: Jun. 6, 2017

(54) PERSON SUPPORT APPARATUS WITH PIVOTING BACKREST

(71) Applicant: Stryker Corporation, Kalamazoo, MI (US)

(72) Inventors: Anish Paul, Portage, MI (US); Matthew A. Cutler, Portage, MI (US); Tyler Joseph Ethen, Portage, MI (US); Christopher S. Hough, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 14/984,403

(22) Filed: Dec. 30, 2015

(65) Prior Publication Data

US 2016/0227929 A1 Aug. 11, 2016

Related U.S. Application Data

(63) Continuation-in-part of application No. 14/212,253, filed on Mar. 14, 2014, now Pat. No. 9,351,890, and (Continued)

(51) Int. Cl.
*A61G 5/10* (2006.01)
*A61G 5/12* (2006.01)

(52) U.S. Cl.
CPC ..... *A61G 5/10* (2013.01); *A61G 5/122* (2016.11); *A61G 5/125* (2016.11); *A61G 5/127* (2016.11);

(Continued)

(58) Field of Classification Search
CPC .... B62B 3/00; B62B 3/02; B62B 3/10; B62B 7/06; B62B 7/08; A61G 1/017;

(Continued)

(56) References Cited

U.S. PATENT DOCUMENTS 3,787,089 A 1/1974 Wrethander
5,790,997 A * 8/1998 Ruehl ..... A47C 17/162 297/316

(Continued)

FOREIGN PATENT DOCUMENTS

EP 1031337 A1 8/2000
EP 1859765 A2 11/2007
EP 1997466 A2 12/2008

OTHER PUBLICATIONS

European Search Report for EP14770826 dated Sep. 13, 2016, a European counterpart to U.S. Appl. No. 14/984,403.

(Continued)

*Primary Examiner* — John Walters
*Assistant Examiner* — James Triggs
(74) *Attorney, Agent, or Firm* — Warner Norcross & Judd LLP

(57) ABSTRACT

A chair includes a backrest that pivots with respect to the seat in a manner that improves the occupant's experience during the transition from an upright position to a reclined position. During pivoting of the backrest with respect to the seat, the backrest moves in a manner having an instantaneous center of rotation that does not remain stationary during the pivoting of the backrest. In some embodiments, the instantaneous center of rotation begins at a location lower than a height of the seat and moves backward as the backrest pivots from the upright position to the reclined position. The movement of the instantaneous center of rotation follows a smoothly curved path that has a continuous first derivative and, in some embodiments, continuous higher order derivatives as well. The movement may be effectuated via pins coupled to the backrest that ride in smoothly curved channels defined in a seat frame.

24 Claims, 13 Drawing Sheets

Related U.S. Application Data a continuation-in-part of application No. 14/801,167, filed on Jul. 16, 2015.

(60) Provisional application No. 61/791,255, filed on Mar. 15, 2013, provisional application No. 62/029,142, filed on Jul. 25, 2014.

(52) U.S. Cl.
CPC ..... *A61G 5/1059* (2013.01); *A61G 2203/10* (2013.01); *A61G 2203/74* (2013.01)

(58) Field of Classification Search
CPC ..... A61G 13/08; A47C 7/40; A47C 17/16; A17C 1/022
See application file for complete search history.

(56) References Cited

U.S. PATENT DOCUMENTS

| | | | | |
|---|---|---|---|---|
| 6,161,229 | A | 12/2000 | Ryan et al. | |
| 8,882,190 | B2 * | 11/2014 | Garland ..... | A47C 7/506 297/85 L |
| 2007/0114828 | A1 | 5/2007 | Corcoran | |
| 2010/0066056 | A1 | 3/2010 | Li et al. | |
| 2010/0212087 | A1 | 8/2010 | Leib et al. | |

OTHER PUBLICATIONS

European Written Opinion for EP14770826 dated Sep. 13, 2016, a European counterpart to U.S. Appl. No. 14/984,403.

* cited by examiner

PERSON SUPPORT APPARATUS WITH PIVOTING BACKREST

CROSS-REFERENCE TO RELATED APPLICATIONS

This application is a continuation-in-part of U.S. patent application Ser. No. 14/212,253 filed Mar. 14, 2014 by inventors Christopher Hough et al. and entitled MEDICAL SUPPORT APPARATUS, which claims priority to U.S. provisional patent application 61/791,255 filed Mar. 15, 2013, by the same inventors and bearing the same title. This application is also a continuation-in-part of U.S. patent application Ser. No. 14/801,167 filed Jul. 16, 2015 by inventors Anish Paul et al. and entitled MEDICAL SUPPORT APPARATUS, which claims priority to U.S. provisional patent application Ser. No. 62/029,142 filed Jul. 25, 2014, by the same inventors and bearing the same title. The complete disclosure of all four of these patent applications is incorporated herein by reference.

BACKGROUND

The present disclosure relates to person support apparatuses, such as, but not limited to, beds, cots, stretchers, recliners, chairs, operating tables, and the like; and more particularly to a backrest of the person support apparatus that is pivotable with respect to a seat area of the person support apparatus.

Person support apparatuses often include a pivotable backrest. The pivoting of the backrest may create shear forces along the occupant's back as the angle of the back rest is changed. Such shear forces result from the backrest not moving in the same manner as the occupant's back as the occupant changes from a sitting position to an upright position, or vice versa.

SUMMARY

In its various embodiments, the present disclosure provides a person support apparatus having a more comfortable pivoting motion for the occupant. In some embodiments, the backrest follows a movement pattern having an instantaneous center of rotation that continuously changes as the backrest pivots. The instantaneous center of rotation may move forward as the backrest pivots from the upright position to a reclined position. In some embodiments, the backrest is coupled to the seat frame by a pair of spaced-apart midlinks that configured to remove restrain movement of the backrest in five degrees of freedom with respect to the seat frame, thereby removing mechanical slop in the backrest. These and/or other features are disclosed in the various embodiments discussed herein.

According to one embodiment, a person support apparatus is provided that includes a frame, a seat supported on the frame, a backrest, and a link assembly. The backrest is pivotable between an upright position and a reclined position. The link assembly is coupled to the seat and the backrest and is configured to continuously move an instantaneous center of rotation of the backrest as the backrest pivots between the upright position and the reclined position.

According to another embodiment, a person support apparatus is provided that includes a frame, a seat, a backrest, right and left midlinks, and a cross bar. The backrest is pivotable between an upright position and a reclined position. The right midlink has a front end and a back end, wherein the front end is pivotably coupled to the seat and the back end is pivotably coupled to the backrest. The left midlink has a front end and a back end, wherein the front end is pivotably coupled to the seat and the back end is pivotably coupled to the backrest. The cross bar rigidly couples the right and left midlinks together.

In other embodiments, the instantaneous center of rotation is located at a first position when the backrest is in the upright position and the instantaneous center of rotation is located at a second position when the backrest is in the reclined position. The first position is located forwardly of the second position. The first and second positions are both located at a height less than a top surface of the seat, in at least one embodiment.

The displacement between the first and second positions, in some embodiments, has a front-back component with a magnitude that is greater than the magnitude of the up-down component of the displacement between the first and second positions.

In some embodiments, the link assembly is configured to move the instantaneous center of rotation along a path between the first and second positions that remains at all times below the height of the top surface of the seat.

The link assembly may be configured to move the instantaneous center of rotation along a path that is defined by a mathematical spline.

In some embodiments, the link assembly includes the right midlink and the left midlink. The right midlink is pivotably coupled to the backrest at a back end of the right midlink and pivotably coupled to the seat at a front end of the right midlink. The left midlink is pivotably coupled to the backrest at a back end of the left midlink and pivotably coupled to the seat at a front end of the left midlink. A cross bar is included, in some embodiments, that rigidly couples the right and left midlinks to each other.

The right midlink and the left midlink each include a front aperture for receiving a pin coupled to a seat frame. In some embodiments, the right and left midlinks each have a thickness that is at least as large as a diameter of the pin. In such embodiments, no cross bar is included for rigidly coupling the right and left midlinks together.

The seat is configured, in some embodiments, to include a seat pan pivotably mounted to a seat frame. The seat frame has a right side plate and a left side plate coupled together by a cross bar. The right side plate includes a right slot defined therein and the left side plate includes a left slot defined therein. A right pin is inserted into the right slot and a left pin is inserted into the left slot. The right pin is coupled to a right side of the backrest and the left pin is coupled to a left side of the backrest. The right and left slots both define an identical shape. In some embodiments, the shape has a curvature between opposite ends of the slots that can be plotted as a mathematical function having a continuous first derivative. In still other embodiments, the mathematical function has a continuous second derivative and/or continuous higher order derivatives.

The backrest contains no direct links to the frame, in at least one embodiment, and the seat is pivotably mounted to the frame.

In still other embodiments, the seat is pivotably supported on the frame and the cross bar pivots with respect to the frame when the seat pivots with respect to the frame.

An electric actuator is included in some embodiments, that has a first end coupled to the backrest and a second end coupled to the seat frame.

The seat pan is supported on the seat frame, in at least one embodiment, by a plurality of load cells configured to detect a magnitude of weight supported by the seat pan.

Before the various embodiments disclosed herein are explained in detail, it is to be understood that the claims are not to be limited to the details of operation, to the details of construction, or to the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

DETAILED DESCRIPTION OF THE EMBODIMENTS

Figure 1:
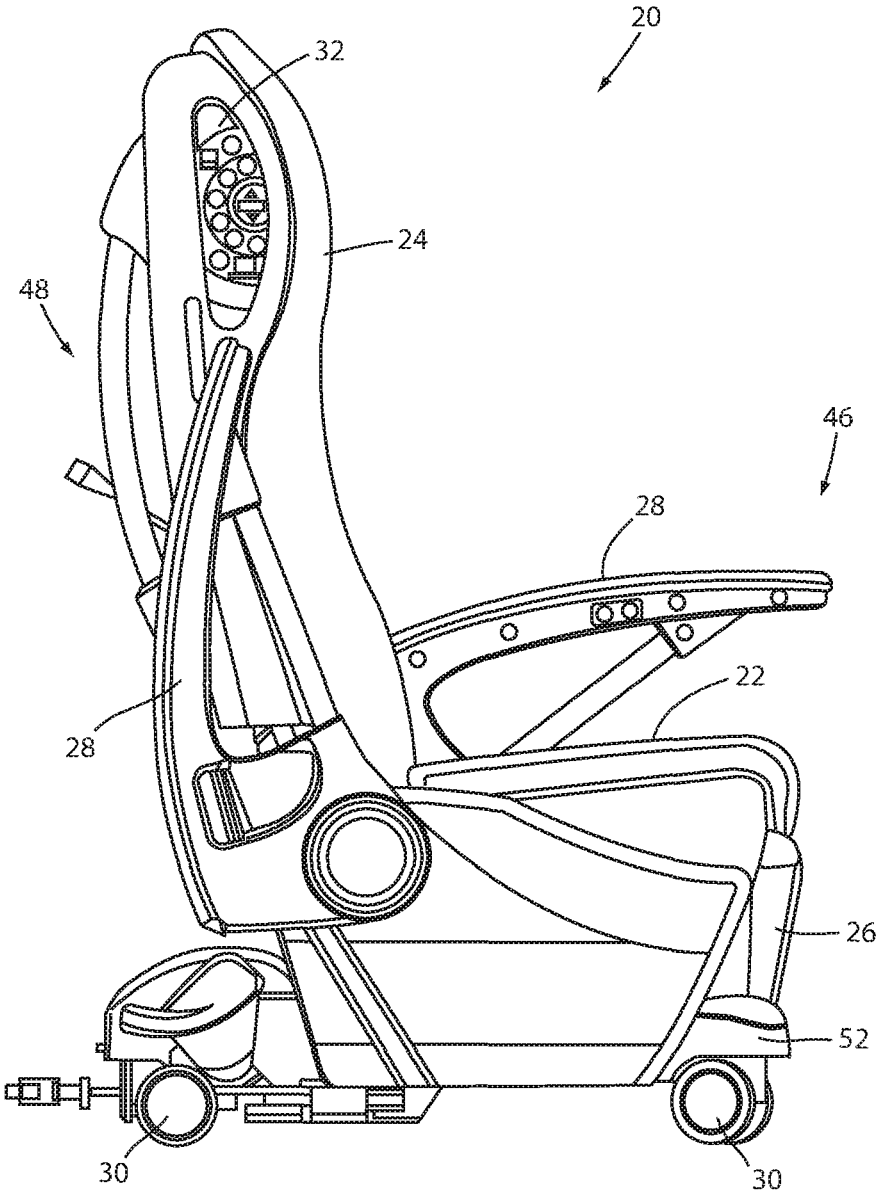
FIG. 1 is a side elevation view of one embodiment of a person support apparatus according to one aspect of the present disclosure.

A person support apparatus 20 according to one embodiment is shown in FIG. 1. Person support apparatus 20 is shown in FIG. 1 to be a recliner. Although the following written description will be made with respect to a recliner, it will be understood by those skilled in the art that the principles disclosed herein may also be incorporated into other types of person support apparatuses besides recliners, such as, but not limited to, beds, stretchers, cots, surgical tables, chairs, or the like.

Figure 2:
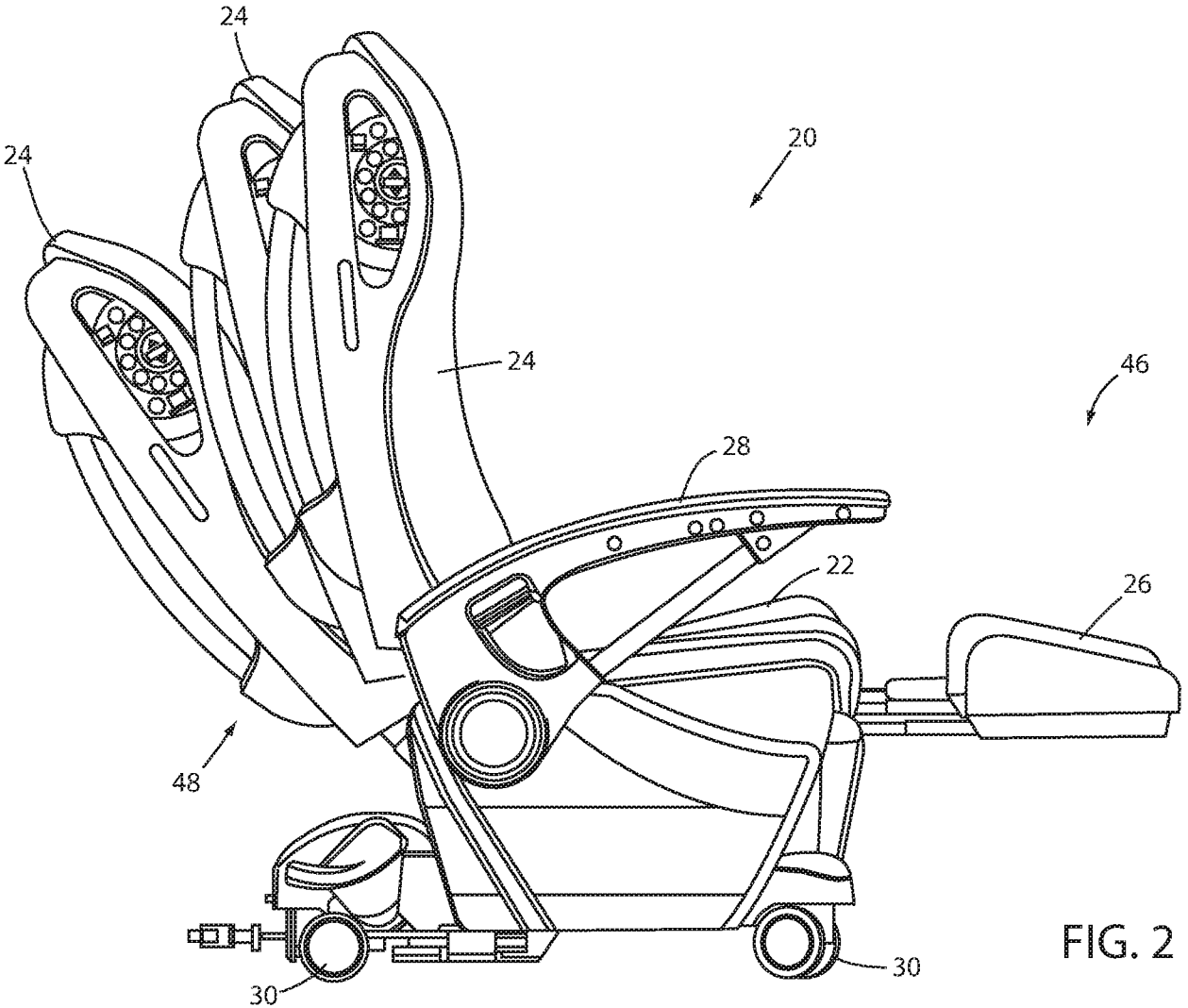
FIG. 2 is a side elevation view of the person support apparatus of FIG. 1 shown with its backrest pivoted to different positions and its leg rest extended.

Person support apparatus 20 includes a seat 22, a backrest 24, a leg rest 26, a pair of armrests 28, and a plurality of wheels 30 (FIGS. 1 & 2). Person support apparatus 20 is constructed such that both the height and tilt of seat 22 is adjustable. Further, person support apparatus 20 is constructed such that backrest 24 is pivotable between a generally upright position, such as shown in FIG. 1, and a virtually infinite number of rearwardly reclined positions, several of which are illustrated in FIG. 2. Leg rest 26 is constructed such that it is able to be moved between a retracted position, such as shown in FIG. 1, and an extended position in which leg rest 26 is oriented generally horizontally and extends forwardly from seat 22, such as shown in FIG. 2. Armrests 28, in the illustrated embodiment, are constructed such that a user can pivot them between a lowered position and a raised position. FIG. 1 illustrates one of the armrests 28 in the raised position and the other of the armrests 28 in the lowered position.

In at least one embodiment, those components of person support apparatus 20 that are not explicitly described herein are constructed in accordance with any of the embodiments disclosed in commonly assigned, copending U.S. patent application Ser. No. 14/212,253 filed Mar. 14, 2014 by inventors Christopher Hough et al. and entitled MEDICAL SUPPORT APPARATUS, the complete disclosure of which is incorporated herein by reference. The movement and control of person support apparatus 20 may also be carried out in accordance with the disclosure of commonly assigned, copending U.S. patent application Ser. No. 14/801,167 filed Jul. 16, 2015 by inventors Anish Paul et al. and entitled MEDICAL SUPPORT APPARATUS, the complete disclosure of which is also incorporated herein by reference. Person support apparatus 20 may also be constructed in other manners besides those described in these two commonly assigned patent applications.

Figure 3:
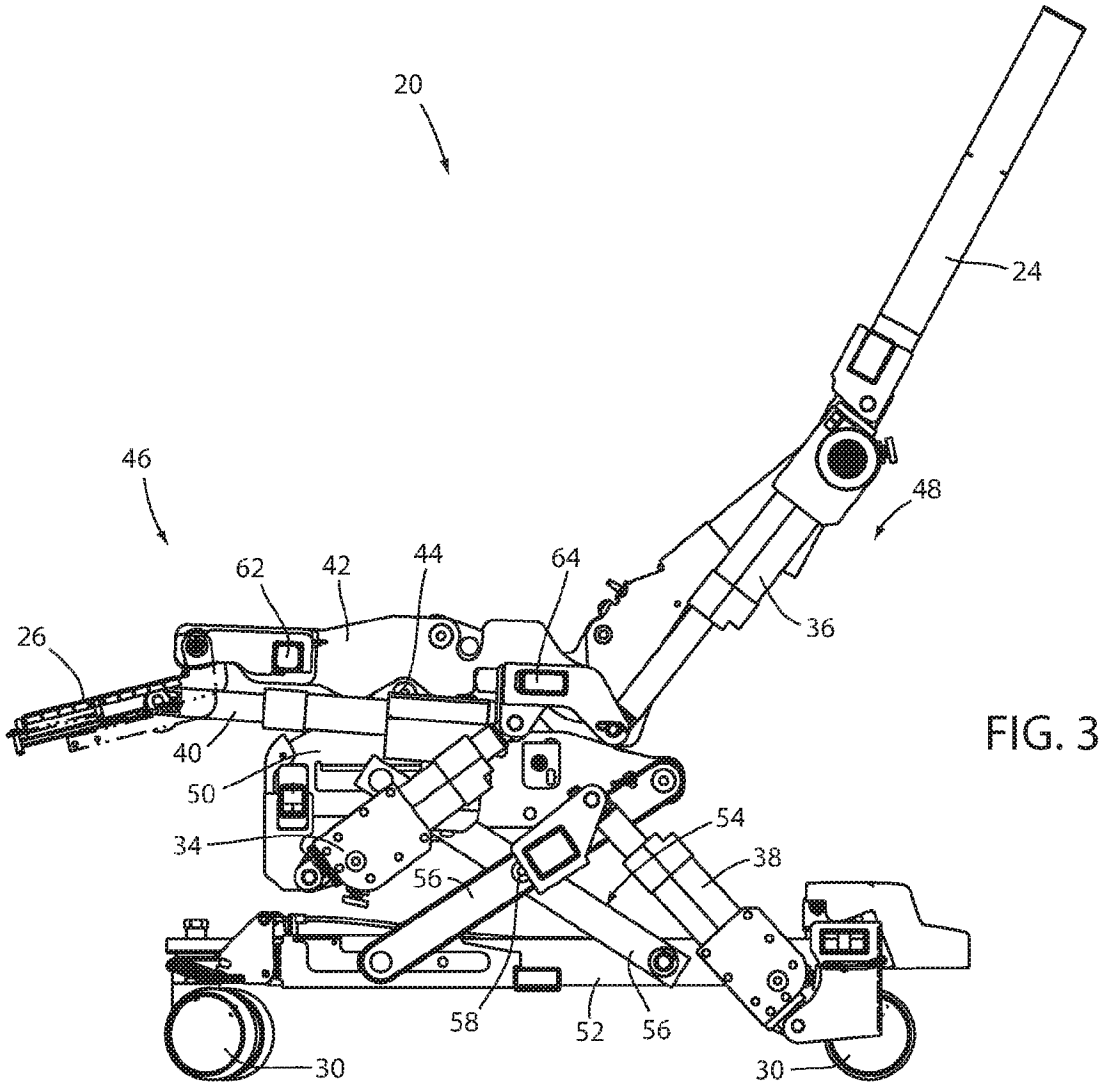
FIG. 3 is a side elevation view of the person support apparatus of FIG. 1 shown with several components removed in order to illustrate a plurality of actuators incorporated into the person support apparatus.

FIG. 3 shows various internal components of person support apparatus 20, including a seat actuator 34, a backrest actuator 36, a lift actuator 38, and a leg rest actuator 40. Each of actuators 32, 34, 36, and 38 are motorized linear actuators that are designed to linearly extend and retract under the control of a controller, such as a microcontroller. The microcontroller is in communication with one or more control panels 32 that may be positioned on each side of the backrest 24 (FIGS. 1 and 2). Control panels 32 are manipulated by a user in order to control the movement and other functions of person support apparatus 20.

Figure 4:
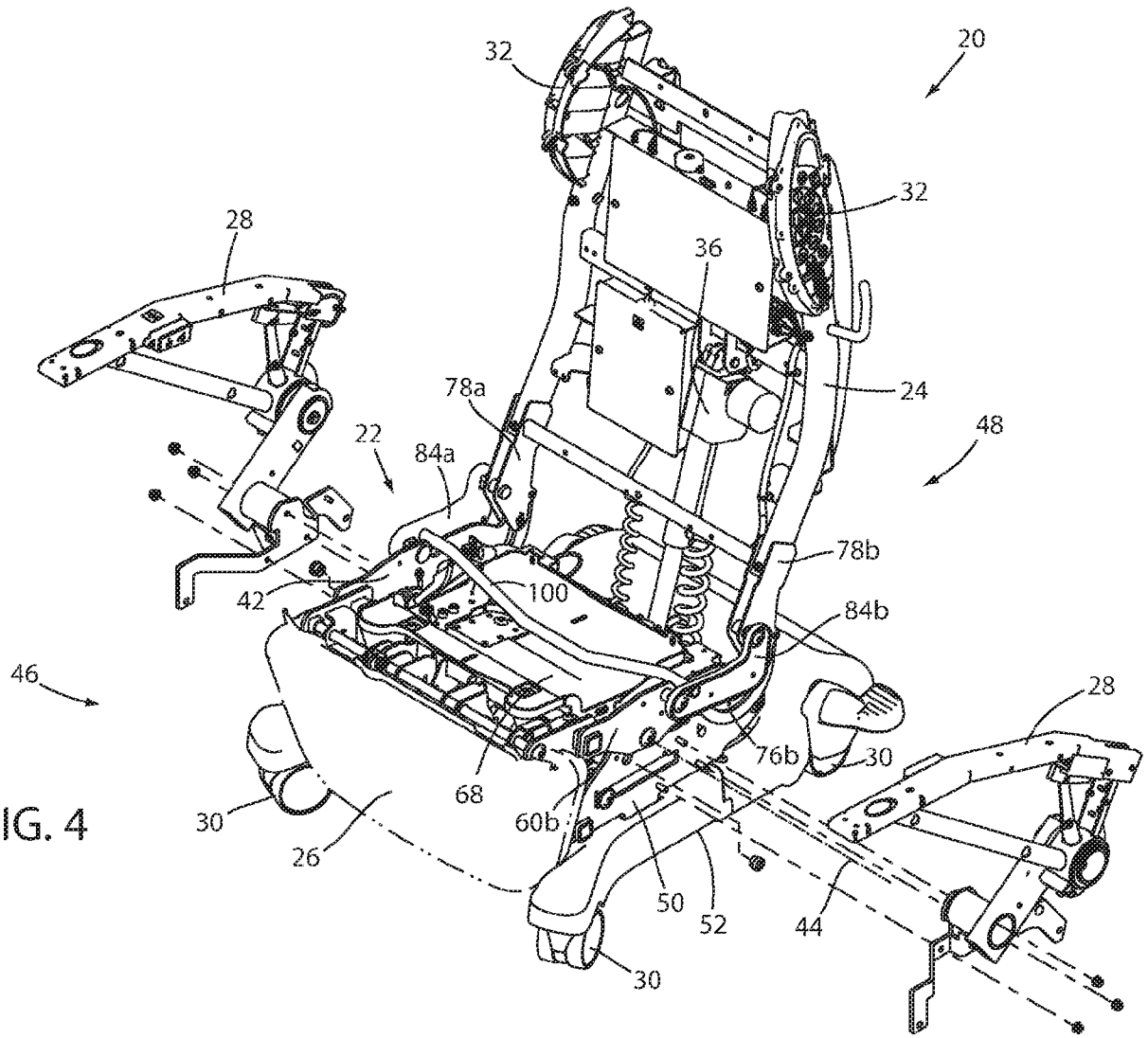
FIG. 4 is a perspective view of the person support apparatus of FIG. 1 shown with several components removed in order to illustrate the connection between the seat and the backrest.

When seat actuator 34 extends or retracts, it causes a seat frame 42 to pivot about a seat pivot axis 44. The extension of seat actuator 34 therefore causes seat frame 42 to tilt in such a manner that a forward end 46 of seat 22 moves downward relative to a backward end 48 of seat 22 (i.e. seat frame 42 rotates in a counterclockwise direction as shown in FIG. 3). The retraction of seat actuator 34, in contrast, causes seat frame 42 to tilt in the opposite manner (i.e. seat frame 42 rotates in a clockwise direction as shown in FIG. 3). Seat pivot axis 44 is defined where seat frame 42 is pivotally mounted to a chair frame 50 (FIGS. 3 & 4). As will be discussed further below, chair frame 50 is height adjustable, and the raising or lowering of chair frame 50 has the effect of raising or lowering seat frame 42, as well as those components coupled to seat frame 42 (e.g. backrest 24 and leg rest 26).

Backrest actuator 36 is mounted to backrest 24 and to seat frame 42. The extension and retraction of backrest actuator 36 therefore causes backrest 24 to pivot with respect to seat frame 42. More specifically, when backrest actuator 36 extends, backrest 24 rotates in a counterclockwise direction in FIG. 3. In contrast, when backrest actuator 36 retracts, backrest 24 rotates in a clockwise direction in FIG. 3. Because backrest 24 is coupled to seat frame 42, the rotation of seat frame 42 by seat actuator 34 also causes backrest 24 to rotate with respect to the floor as seat frame 42 rotates. This rotation, however, is independent of the rotation of backrest 24 caused by backrest actuator 36. In other words, the relative angle between backrest 24 and seat frame 42 only changes when backrest actuator 36 is actuated (and not when seat actuator 34 extends or retracts while backrest actuator 36 does not change length). The angle of backrest 24 with respect to the floor (or another fixed reference), however, changes as seat frame 42 pivots about seat pivot axis 44, or as backrest actuator 36 pivots backrest 24.

Leg rest actuator 40 is mounted to seat frame 42 and to leg rest 26. The extension of leg rest actuator 40 therefore pivots leg rest 26 from a retracted position (e.g. FIG. 1) to an extended position in front of seat 22 (FIG. 2). The physical construction of leg rest 26 may take on any of the forms disclosed in the commonly assigned U.S. patent application Ser. No. 14/212,253 mentioned above, whose disclosure is incorporated completely herein by reference. Other physical constructions of leg rest 26 are also possible. The extension and retraction of leg rest actuator 40 changes the orientation of leg rest 26 with respect to seat frame 42. The orientation of leg rest 26 with respect to seat frame 42 does not change based on the extension or contraction of any other actuators 34, 36, or 38. The orientation of leg rest 26 with respect to the floor (or some other fixed reference), however, changes when seat frame 42 is pivoted about seat pivot axis 44 by seat actuator 34, or when leg rest actuator 40 pivots leg rest 26. In summary, then, the pivoting of seat frame 42 about its pivot axis 44 therefore simultaneously changes the orientations of all of seat 22, backrest 24, and leg rest 26 with respect to the floor (or other fixed reference), but does not, by itself, change the orientations of any of these components (seat 22, backrest 24, and leg rest 26) with respect to each other.

Lift actuator 38 is coupled to a base 52 by an X-frame lift 54. X-frame lift 54 includes two legs 56 that are pivotally coupled to each other about a center axis 58. When lift actuator 38 extends or retracts, the relative angle between each of the legs 56 changes, which changes the overall height of X-frame lift 54. Further, because frame 50 is mounted on a top end of X-frame lift 54, the changing height of X-frame lift 54 changes the height of frame 50. Lift actuator 38 therefore raises the height of frame 50 when it extends and lowers the height of frame 50 when it retracts. Because seat frame 42 is mounted (pivotally) on frame 50, and because backrest 24 and leg rest 26 are both mounted to seat frame 42, raising and lowering the height of frame 50 simultaneously raises and lowers the height of seat 22, backrest 24, and leg rest 26. However, extending and retracting lift actuator 38 does not, by itself, change the angular orientations of any of leg rest 26, backrest 24, and/or seat 22, either with respect to each other or with respect to the floor.

Each of the actuators 34-40 is powered by a direct current (DC) electrical motor. That is, each of the actuators 34-40 extends or retracts in response to its associated motor being driven in one direction or its opposite direction. The control of each motor is carried out by a control system in communication with control panels 32. Control panels 32 may be constructed in the same manner as, operate in the same manner as, and/or carry out any one or more of the same functions that are carried out using the control panels disclosed in any of the following commonly assigned U.S. patent applications: Ser. No. 14/838,693 filed Aug. 28, 2015 by inventors Daniel Brosnan et al. and entitled PERSON SUPPORT APPARATUS WITH ACTUATOR BRAKE CONTROL; Ser. No. 14/549,006 filed Nov. 20, 2014 by inventors Richard Derenne et al. and entitled PERSON SUPPORT APPARATUSES WITH VIRTUAL CONTROL PANELS; Ser. No. 62/166,354 filed May 26, 2015 by inventors Michael Hayes et al. and entitled USER INTERFACES FOR PATIENT CARE DEVICES; Ser. No. 62/171,472 filed Jun. 5, 2015 by inventors Aaron Furman et al. and entitled PATIENT SUPPORT APPARATUSES WITH DYNAMIC CONTROL PANELS; and Ser. No. 62/186,464 filed Jun. 30, 2015 by inventors Marko Kostic et al. and entitled PERSON SUPPORT APPARATUSES WITH LOAD CELLS, the complete disclosures of all of which are hereby incorporated herein by reference in their entirety.

Figure 5:
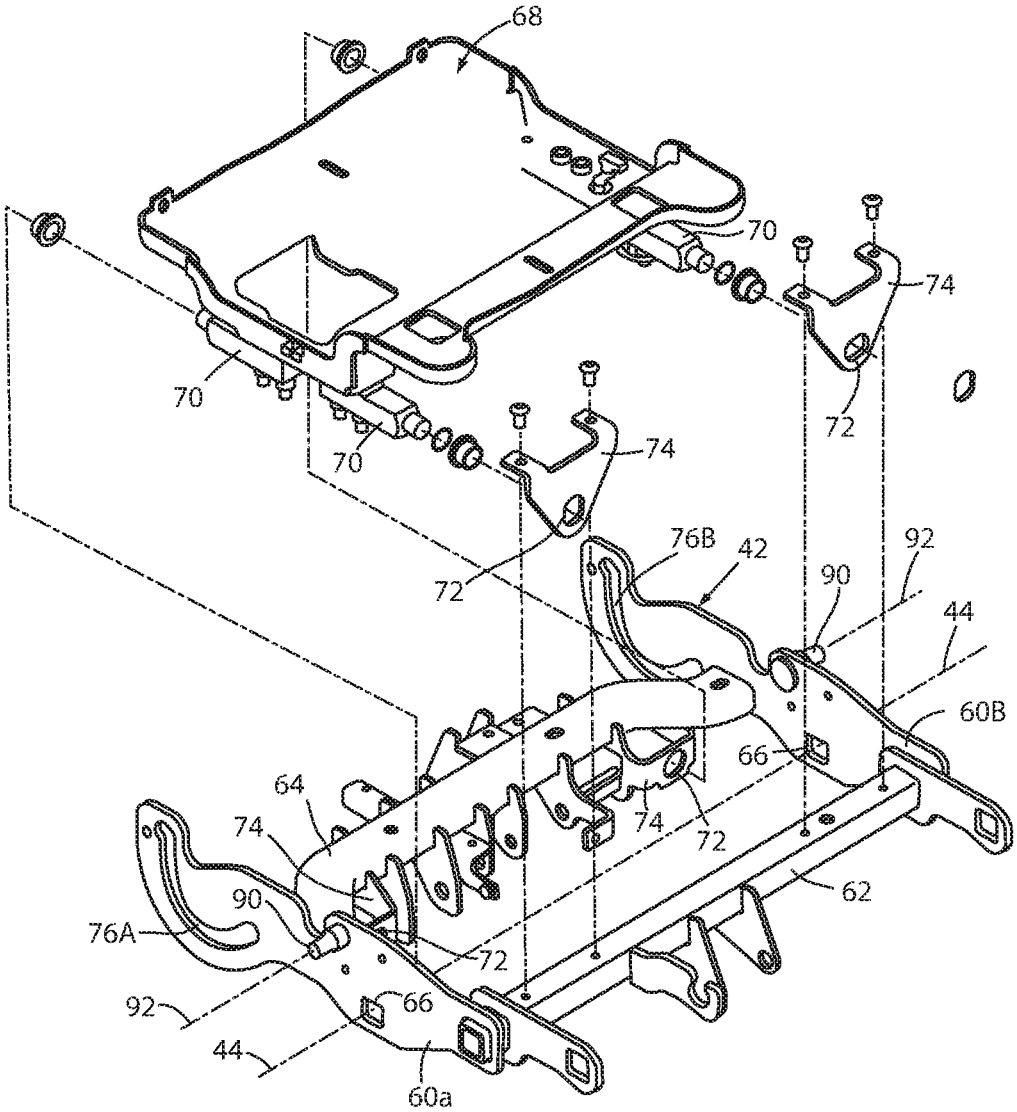
FIG. 5 is an exploded, perspective view of a seat pan and seat frame of the person support apparatus of FIG. 1.
Figure 6:
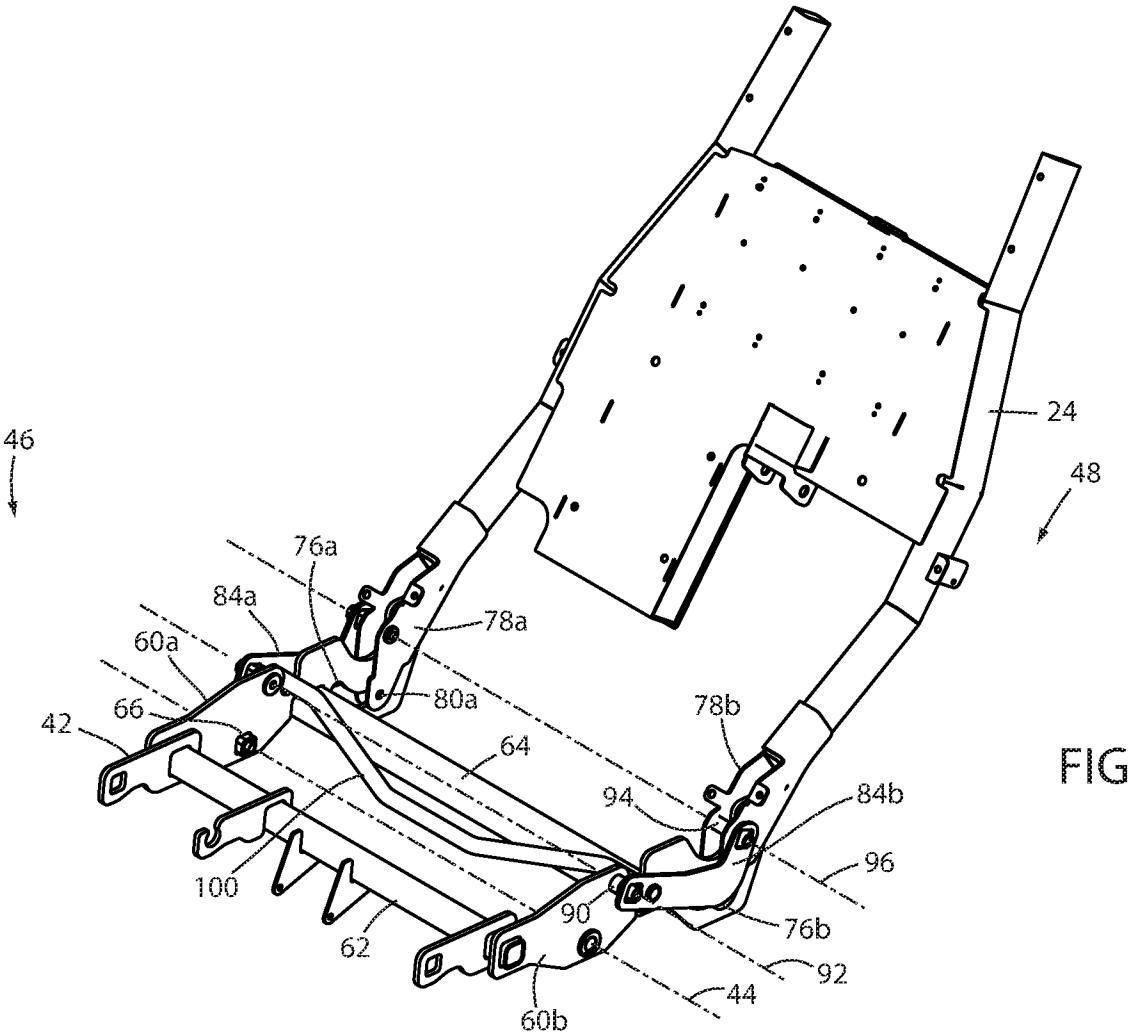
FIG. 6 is a perspective view of the backrest, seat frame, and link assembly of the person support apparatus of FIG. 1.

FIGS. 4-6 illustrate in greater detail the mechanical coupling of seat frame 42 to chair frame 50 and backrest 24. As can be seen more clearly in FIG. 5, seat frame 42 includes a right side plate 60*a* and a left side plate 60*b*. Right and left side plates 60*a* and 60*b* are coupled together by way of a front cross bar 62 and a rear cross bar 64. Right and left side plates 60*a* and 60*b* each include an aperture 66 defined therein that is adapted to receive a pivot pin (not shown) coupled to chair frame 50. A bushing, or similar structure (not shown), is inserted into aperture 66 and receives the pivot pin from chair frame 50, thereby allowing seat frame 42 to pivot about seat pivot axis 44. As shown in FIG. 5, seat pivot axis 44 runs directly through apertures 66.

Seat frame 42 is adapted to support a seat pan 68 thereon (FIG. 5). Seat pan 68, in turn, is configured to support upholstery, cushioning, or other structures thereon that define a soft seating surface for an occupant of person support apparatus 20. Seat pan 68 is mounted to seat frame 42 by way of a plurality of load cells 70. Load cells 70 are fixedly coupled at their base to seat pan 68 and inserted through apertures 72 defined in a plurality of load cell brackets 74. A front pair of load cell brackets 74 are fixedly mounted to front cross bar 62, while a rear pair of load cell brackets 74 are fixedly mounted to rear cross bar 64.

The mounting of seat pan 68 to seat frame 42 via load cells 70 enables load cells 70 to detect the weight of an occupant on person support apparatus 20. Load cells 70 may therefore be used as part of a scale system integrated in person support apparatus 20 for measuring the occupant's weight. Alternatively, or additionally, the load cells 70 may be used as part of an exit detection system integrated into person support apparatus 20 that provides an alert when an occupant of person support apparatus 20 exits therefrom. Further details of one manner of mounting load cells 70 to brackets 74 and seat frame 42, as well as further details regarding the use of load cells 70 in a scale system or exit detection system, may be found in commonly assigned U.S. patent application Ser. No. 62/389,892, filed Dec. 17, 2015 and entitled PERSON SUPPORT APPARATUS WITH EXIT DETECTION SYSTEM AND/OR SCALE SYSTEM, the complete disclosure of which is hereby incorporated herein by reference.

Seat frame 42 further includes a right slot 76*a* defined toward a back end of right side plate 60*a*, as well as a left slot 76*b* defined toward a back end of left side plate 60*b* (FIG. 5). Slots 76*a* and 76*b* are both identically shaped. Further, the shape of slots 76*a* and 76*b* is smoothly curved. That is, slots 76*a* and 76*b* avoid any sharp bends, turns, or other abrupt changes in direction. More precisely, in at least one embodiment, the smoothness of the curved shape defined by slots 76*a* and 76*b* can be qualitatively described with reference to its mathematical characteristics. As is known to those skilled in the art, the smoothness of a mathematical function can be described with reference to the number of derivatives of the mathematical function that are continuous. That is, the smoother the mathematical function, the greater the number of its derivatives that are continuous. In at least one embodiment of person support apparatus 20, slots 76*a* and 76*b* define a shape that, when represented mathematically, has a first derivative that is continuous everywhere between the ends of the shape. In other embodiments, the curvature of slots 76*a* and 76*b* is even smoother, and includes shapes that, when represented mathematically, have second, or higher order, derivatives that are continuous everywhere between the ends of the shapes.

Right and left slots 76*a* and *b* are used in controlling the pivoting motion of backrest 24 with respect to seat frame 42, as will be discussed in greater detail below. By defining slots 76*a* and 76*b* to have a smoothly curved shape, the pivoting of backrest 24 with respect to seat frame 42 undergoes a smooth pivoting motion free of bumps, jerks, or other discontinuities.

Figure 7:
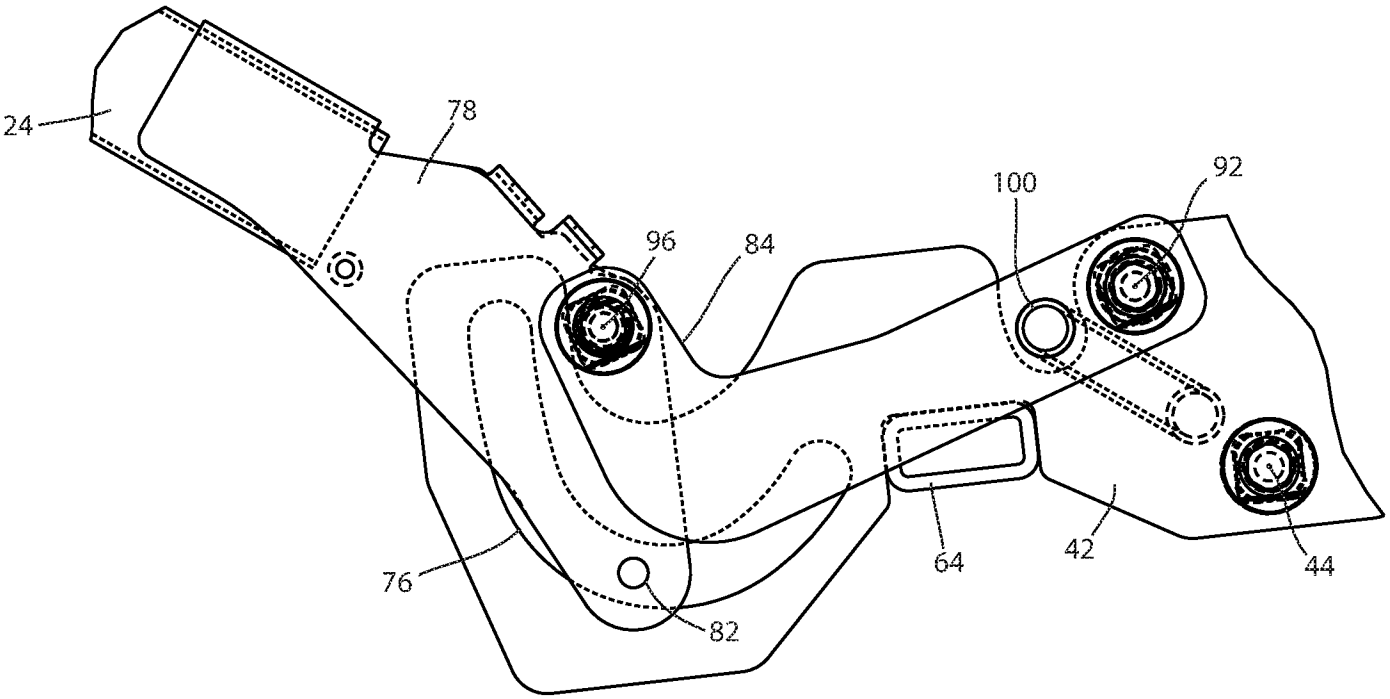
FIG. 7 is a side elevation view of the link assembly between the backrest and seat frame.

Backrest 24 includes a right and left bracket 78 that are used to mount backrest 24 to seat frame 42 (FIGS. 4 & 6). As shown more clearly in FIG. 6, backrest bracket 78*a* includes a pin aperture 80 defined therethrough that receives a pin 82 (FIG. 7). As will be discussed in greater detail below, pin 82 of backrest bracket 78*a* rides inside of right slot 76*a*. Slot 76*a* thereby limits and controls the manner in which backrest 24 pivots with respect to seat frame 42. Although not visible in FIG. 6, left backrest bracket 78*b* likewise includes a pin aperture 80 in which a pin 82 is inserted that rides inside of left slot 76*b*.

A right and left midlink 84*a* and 84*b* are also used to coupled backrest 24 to seat frame 42 (FIGS. 4 and 6-8). As shown more clearly in FIG. 9, midlinks 84*a* and 84*b* each include a front opening 86 and a back opening 88. Front openings 86 are configured to receive a bushing (not shown), or other bearing structure, that rotationally couples to a seat frame pin 90 (FIG. 5). This coupling allows the midlinks 84*a* and *b* to rotate about a front axis 92 with respect to seat frame 42. Rear openings 88 are likewise configured to receive a bushing (not shown), or other bearing structure, that rotationally couples to a backrest pin 94 (FIG. 6). This coupling allows the midlinks 84*a* and *b* to rotate about a rear axis 96 with respect to backrest 24.

Figure 8:
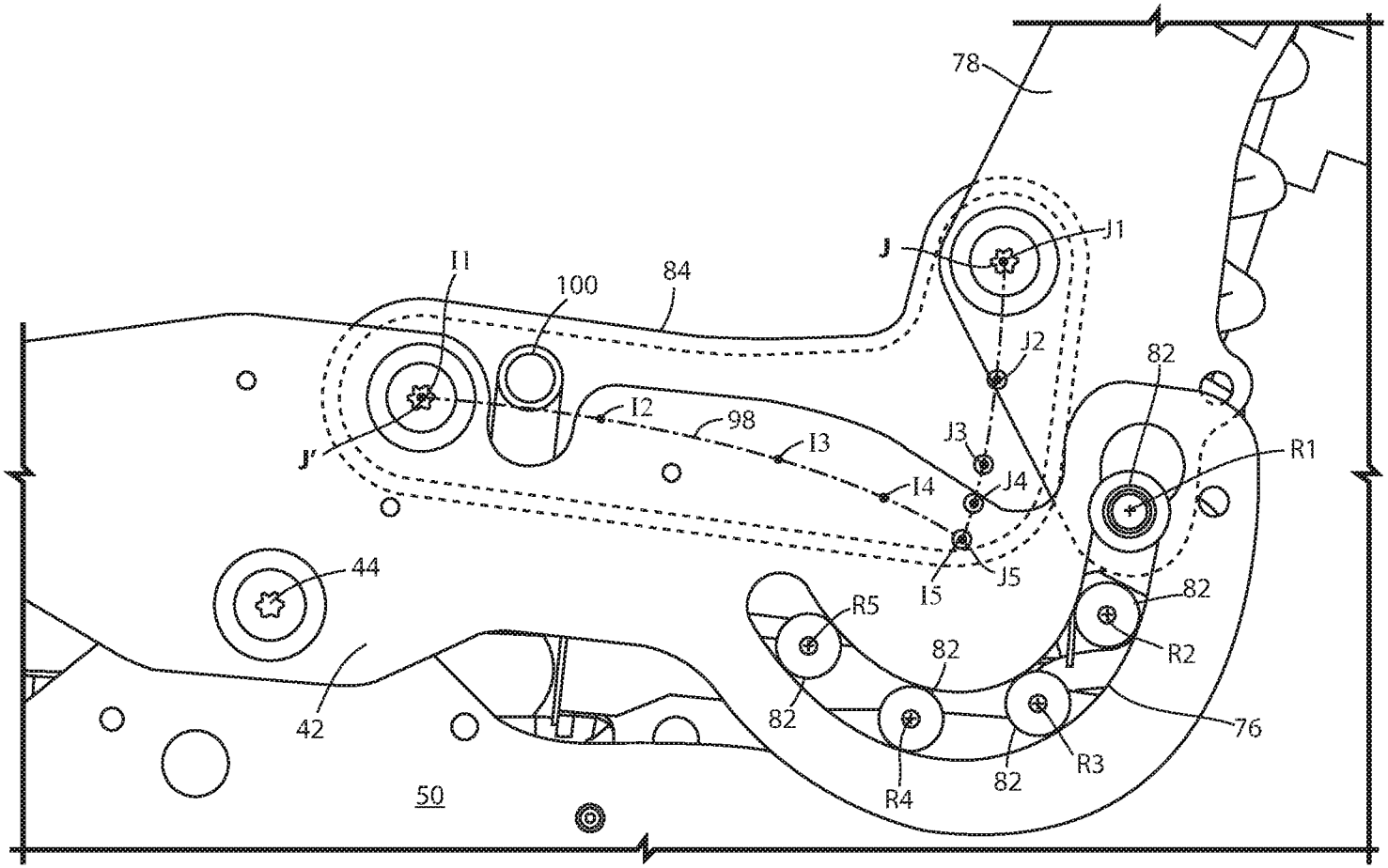
FIG. 8 is a side elevation view of the link assembly between the backrest and seat frame illustrating the movement of the instantaneous center of rotation of the backrest.
Figure 9:
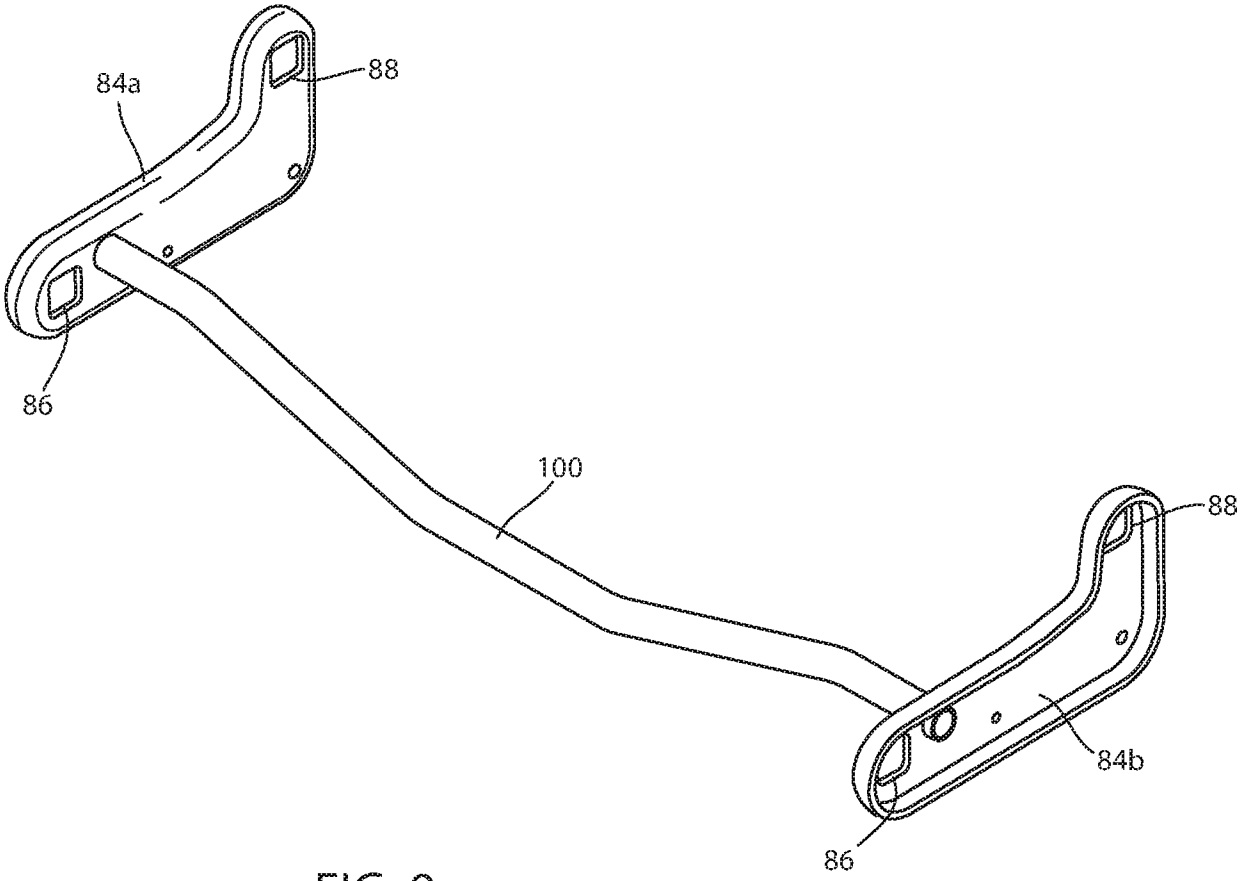
FIG. 9 is a perspective view of a midlink assembly according to one embodiment.

By linking backrest 24 to seat frame 42 with midlinks 84*a* and *b*, as well as by guiding pin 82 within slots 76*a* and *b*, the motion of backrest 24 as it pivots between different positions is controlled such that backrest 24 has an instantaneous center of rotation that does not remain stationary as it pivots between the different positions. The movement of pin 90 and the instantaneous center of rotation of backrest 24 as backrest 24 pivots can better be understood with respect to FIGS. 7-8. Specifically, with respect to FIG. 8, when backrest 24 is in its upright position, pin 82 is positioned at location R1 within slot 76. At this moment, the joint J between backrest 24 and midlink 76 defined by the coupling of pin 94 of backrest 24 within rear aperture 88 of midlink 76 (which defines the location of rear pivot axis 96) is located at position J1. Further, at the moment backrest 24 begins to pivot downwardly (toward a more reclined position) from the initial position shown in FIG. 8, the instantaneous center of rotation of backrest 24 is located at position I1. FIG. 8 illustrates the subsequent positions of each of these locations (joint J, pin 82, and the instantaneous center of rotation I) as backrest 24 is pivoted further backward.

Specifically, when backrest 24 has pivoted sufficiently far back such that pin 82 has moved to location R2 within slot 76, joint J has moved to position J2 and the instantaneous center of rotation of backrest 24 has moved to position I2. When backrest 24 pivots further backward to the position in which pin 82 has moved to location R3 within slot 76, joint J has moved to position J3 and the instantaneous center of rotation has moved to position I3. FIG. 8 also illustrates the joint J at positions J4 and J5. When at these positions, pin 82 in slot 76 is in positions R4 and R5, respectively. Similarly, when in these two positions, the instantaneous center of rotation I is located at positions I4 and I5, respectively.

FIG. 8 therefore illustrates a path 98 followed by the instantaneous center of rotation of backrest 24 as it pivots between upright and reclined positions. Path 98 begins at a first location (I1) when backrest 24 is in an upright position and ends at a second location (I5) when backrest 24 is in a reclined position. As can be seen in FIG. 8, path 98 remains below a top of seat frame 24 along its entire length. Still further, it can be seen from FIG. 8 that the instantaneous center of rotation travels rearwardly when backrest 24 pivots from an upright position to a reclined position. Finally, it can also be seen that, although the height of the instantaneous center of rotation has changed slightly between positions I1 and I5, the predominant change is in the forward-rearward direction. In other words, when comparing the position displacement between locations I1 and I5, the component of the displacement in the forward-rearward direction is much greater than the component of the displacement in the vertical direction. Or, to state it in yet another manner, the instantaneous center of rotation moves backward more than it moves downward as backrest 24 pivots from an upright position to a reclined position.

Midlinks 84 are rigidly coupled together by a cross bar 100 (FIGS. 4 and 6-9). Cross bar 100 is added in some embodiments in order to stabilize midlinks 84 and the connection of backrest 24 to seat frame 42. Without cross bar 100, it is possible for midlinks 84 to move such that the planes defined by midlinks 84 move from being parallel with respect to each other (desired) to an orientation in which they are no longer parallel with respect to each other. Alternatively, or additionally, it is possible for the midlinks 84 to move such that one or both of the front and rear apertures 86 and 88 of one midlink 84 move out of precise alignment with one or both of the front and rear apertures 86 of the other midlink 84. The result of either of these types of movement is such that axis 92 and/or axis 96 cease being a single line segment runs through both sides of person support apparatus 20. Instead, for example, axis 92 becomes separated into a right portion where right midlink 84*a* is joined to right side plate 60*a* and a left portion where left midlink 84*b* is joined to left side plate 60*b*. Further, the right and left portions are not aligned. Alternatively, or additionally, axis 96 can become separated into right and left portions adjacent right and left seat brackets 78*a* and 78*b*, respectively. The result of the separation of axes 92 or 96 into separate non-aligned portions enables backrest 24 to wiggle with respect to seat frame 24, giving it a level of mechanical slop that is undesired. By coupling midlinks 84 rigidly together via cross bar 100, this mechanical slop is substantially eliminated. This coupling ensures that backrest 24 is free to move with respect to midlinks 76 only one degree of freedom (rotation about axis 96), and that midlinks 76 are free to move with respect to seat frame 42 about only one degree of freedom (rotation about front axis 92).

Figure 10:
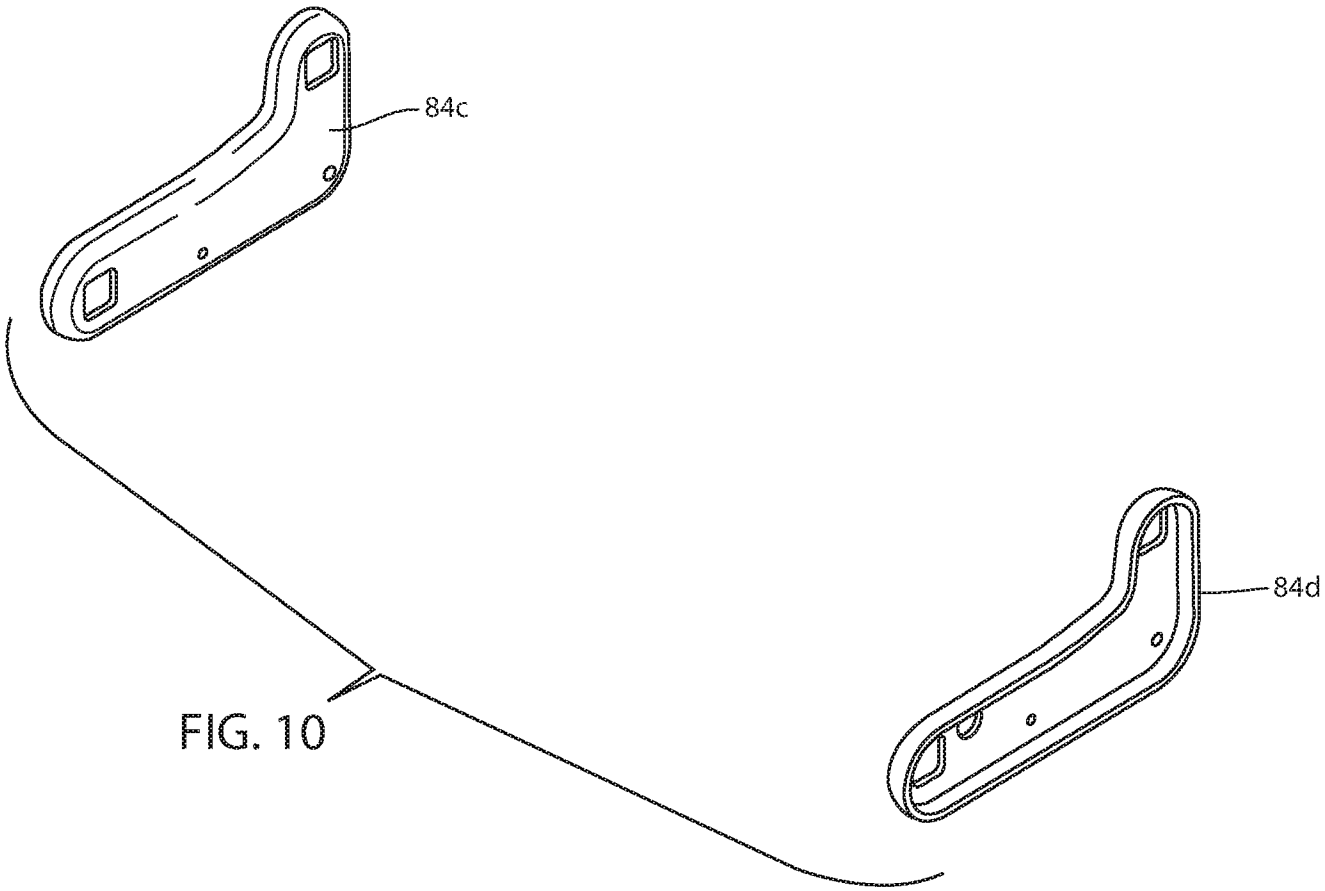
FIG. 10 is a perspective view of an alternative midlink assembly according to another embodiment.

FIG. 10 discloses an alternative manner of restraining the movement of backrest 24 to only a single degree of freedom. Instead of coupling midlinks 84 together via cross bar 100, the motion of backrest 24 is restricted to a single degree of freedom by increasing the thickness of midlinks 84. Specifically, FIG. 10 discloses thickened midlinks 84*c* and 84*d*. The thickness of midlinks 84*c* and 84*d* is of a magnitude generally sufficient to prevent midlinks 84*c* or 84*d* from moving out of a plane that is perpendicular to pivot axes 92 or 94. Although other thickness values may be used, in one embodiment, midlinks 84*c* and 84*d* have a thickness that is at least as large as the outside diameters of pins 90 and 94 (assuming these outside diameters are equal). If pins 90 and 94 do not have the same outside diameter, midlinks 84*c* and 84*d* are constructed with a thickness that is at least as large as the outside diameter or whichever of the pins 90 or 94 has the larger outside diameter. This larger thickness ensures that a greater surface area of midlinks 84 (or the bearing inserted into apertures 86 and/or 88 of midlinks 84) is in contact with the axis defined by pins 90 and 94, thereby better constraining midlinks 84 from moving out of a plane perpendicular to axes 92 and 96.

Figure 11:
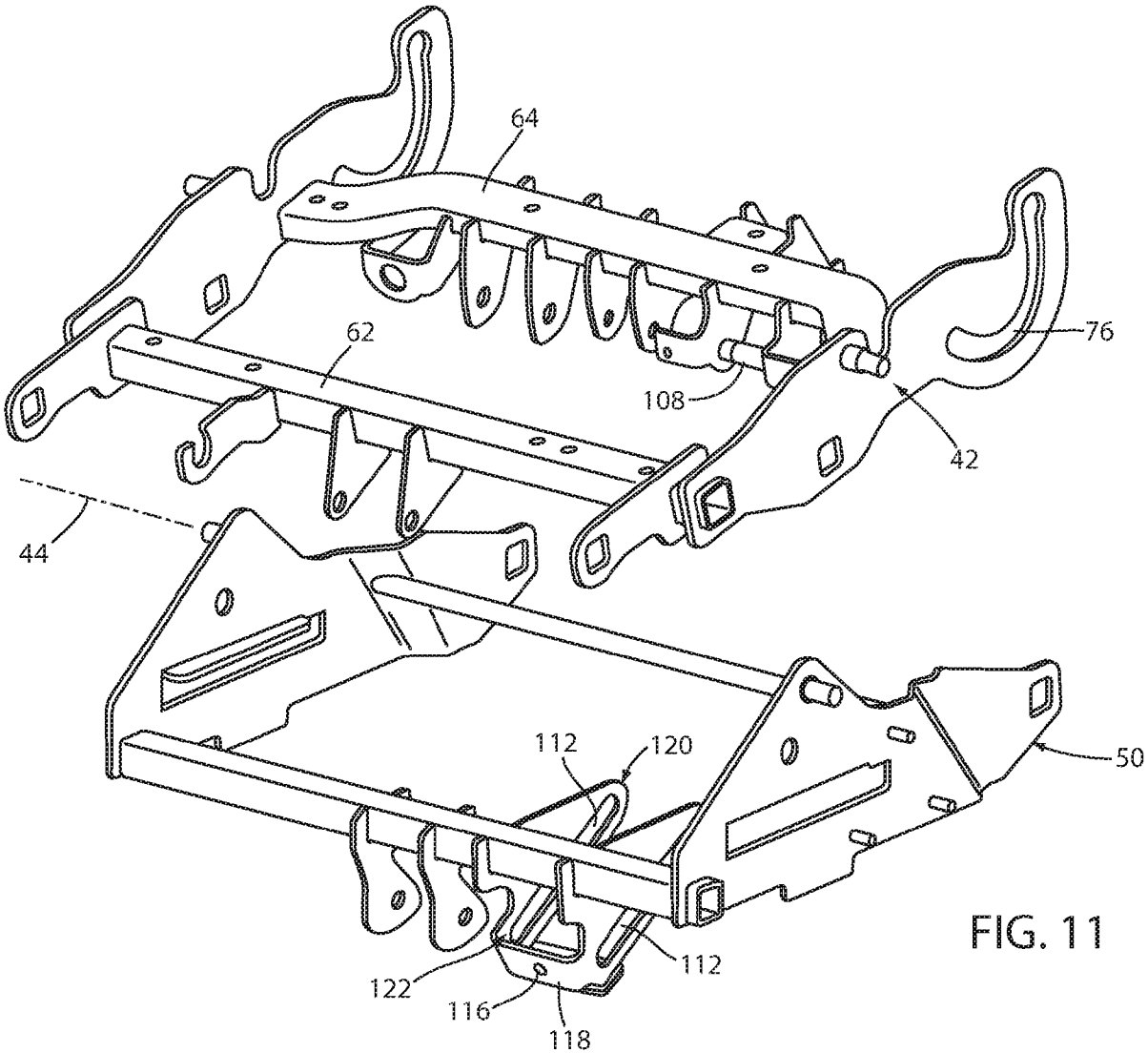
FIG. 11 is a perspective exploded view of the seat frame and a chair frame of the person support apparatus of FIG. 1.
Figure 12:
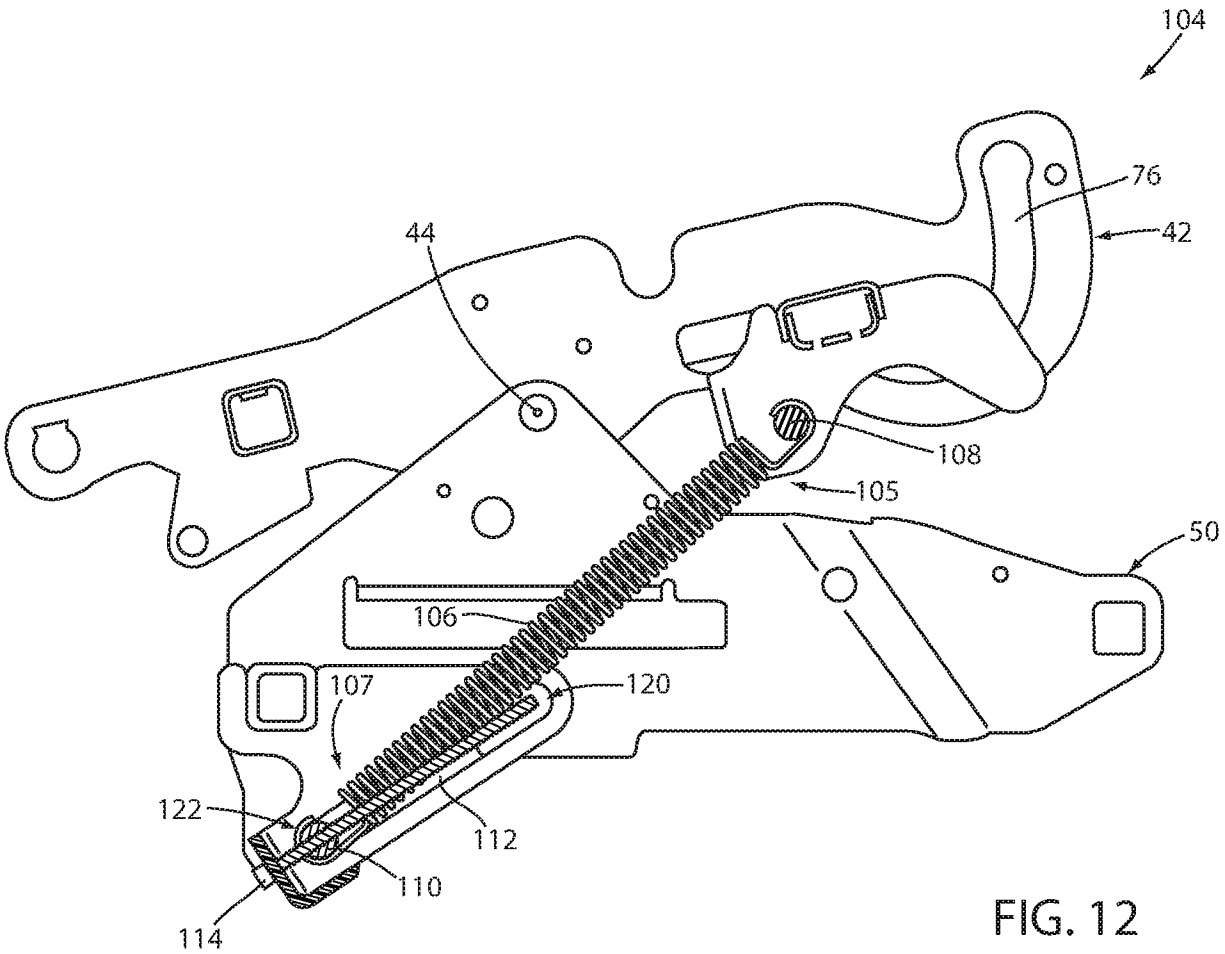
FIG. 12 is a side, sectional view of the seat frame and chair frame of FIG. 11.
Figure 13:
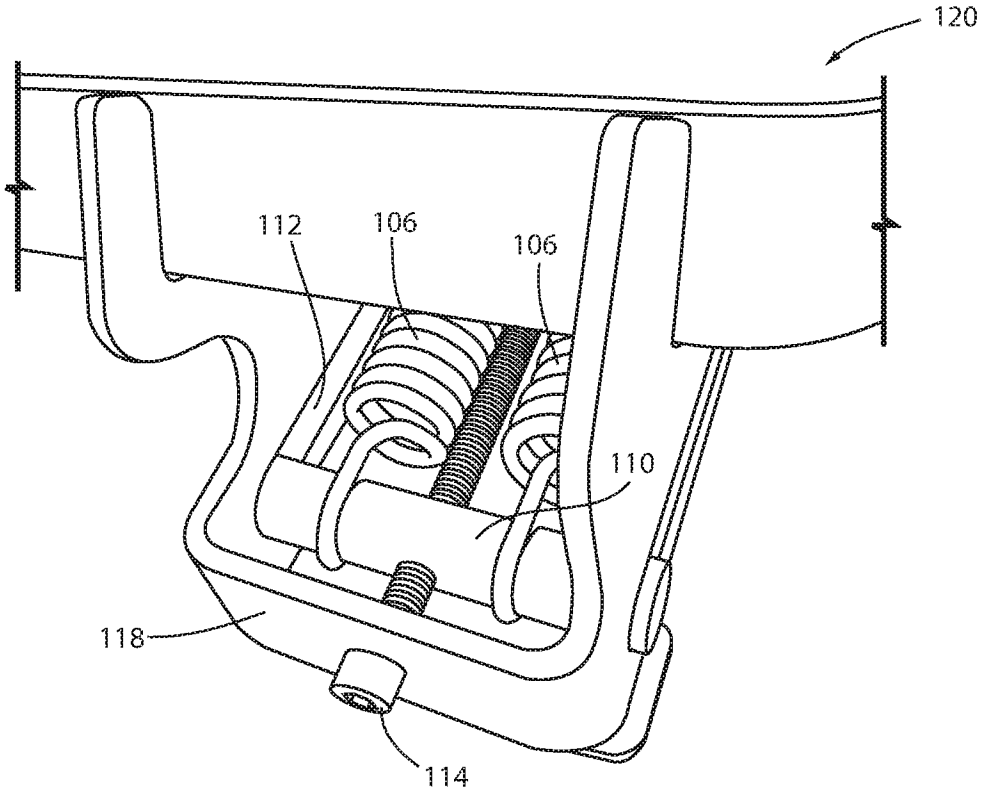
FIG. 13 is a rear perspective view of the seat frame and chair frame illustrating a tensioning system of the person support apparatus of FIG. 1.

FIGS. 12-13 illustrate one embodiment of a tensioning system 104 that is designed to remove any mechanical slop or slack between seat frame 42 and chair frame 50 (FIG. 11). As was noted previously, seat frame 42 is pivotally connected to chair frame 50 about seat pivot axis 44. Seat actuator 34 is coupled between seat frame 42 and chair frame 50 (FIG. 3). Although seat actuator 34 controls the pivoting of seat frame 42 with respect to chair frame 50, the connection of seat actuator 34 between seat frame 42 and chair frame 50 does not necessarily remove all mechanical slack between seat frame 42 and chair frame 50. That is, even when coupled to seat actuator 34, it is possible for seat frame 42 to wiggle a small amount about seat pivot axis 44 when actuator 34 is not being activated. Tensioning system 104 removes this wiggling capability, thereby ensuring that seat frame 42 remains stationary with respect to chair frame 50 (at least when seat actuator 34 is not being activated), and therefore does not experience any mechanical slack with respect to chair frame 50.

Tensioning system 104 includes a pair of springs 106 that are coupled between seat frame 42 and chair frame 50. More specifically, a first end 105 of each spring 106 is coupled to a seat pin 108 on chair frame 42. Seat pin 108 is rigidly coupled to chair frame 42. A second end 107 of each spring 106 is coupled to a slot pin 110. Slot pin 110 is slidingly coupled to chair frame 50. More specifically, slot pin 110 is inserted into a pair of parallel pin slots 112 defined in chair frame 50. A tensioning bolt 114 having external threads is inserted through an aperture in slot pin 110 as well as a pin aperture 116 defined in a plate 118. Pin aperture 116 is internally threaded so that it threadingly mates with the external threads of tensioning bolt 114. Plate 118 is fixedly coupled to chair frame 50.

Rotation of tensioning bolt 114 within pin aperture 116 causes slot pin 110 to move within pin slot 112. Depending upon the direction in which tensioning bolt 114 is rotated (clockwise or counterclockwise), slot pin 110 moves either toward a first end 120 of pin slot 112 or toward a second end 122 of pin slot 112. The tension in springs 106 can therefore be increased by rotating tensioning bolt 114 in a direction that moves slot pin 110 towards second end 122, and the tension in springs 106 can be decreased by rotating tensioning bolt 114 in a direction that moves slot pin 110 towards first end 120. The tension within springs 106 exerts a biasing force on seat frame 42 that urges seat frame 42 to rotate in a clockwise direction (as shown in FIG. 12) about seat pivot axis 44. This biasing force removes any slack that may otherwise exist between seat frame 42 and chair frame 50. That is, by stretching springs 106 such that they exert a sufficient tensioning force on seat frame 42, seat frame 42 will no longer be able to wiggle with respect to chair frame 50, and the only movement of seat frame 42 with respect to chair frame 50 will occur as a result of seat actuator 34 extending or retracting.

In the embodiment shown in FIGS. 12 and 13, tensioning system 104 is designed such that springs 106 do not need to be stretched in order to install them between seat frame 42 and chair frame 50. That is, during the assembly of person support apparatus 20, tensioning bolt 114 is initially rotated such that slot pin 110 is positioned adjacent first end 120 of pin slot 112. At this position, the distance between slot pin 110 and seat pin 108 is small enough that springs 106 can be coupled therebetween without stretching the springs. In other words, first end 105 of springs 106 can be hooked to seat pin 108 and second end 107 of springs 106 can be hooked to slot pin 110 (when pin 110 is adjacent first end 120) without requiring any stretching of springs 106. This simplifies the assembly process as no stretching or pre-tensioning of the springs 106 is required during assembly. Instead, once the springs 106 are coupled to pins 108 and slot pin 110, tensioning bolt 114 is rotated in such a manner as to slide slot pin 110 toward second end 122, thereby stretching springs 106 and increasing their tension. This tensioning is increased until a sufficient biasing force is applied to the seat frame 42 by springs 106 to remove the mechanical slop, yet not unduly burden seat actuator 34 from pivoting seat frame 42 about seat pivot axis 44.

Although tensioning system 104 is shown as being used between seat frame 42 and chair frame 50, it will be understood by those skilled in the art that tensioning system 104 can be applied between other mechanically moving parts of person support apparatus 20. Further, it will be understood by those skilled in the art that tensioning system 104 can be used for removing mechanical slack between moving components of other devices besides person support apparatus 20. Still further, it will be understood that various modifications can be made to tensioning system 104, such as, but not limited to, automatically rotating tensioning bolt 114 through the use of a motor. Further, one or more tensioning sensors can be installed that measure the amount of tension in springs 106 and report the tension readings to a controller, such as a microcontroller. In such a modified embodiment, the controller then automatically adjusts the tensioning bolt by controlling the motor, thereby automatically achieving the desired tension without requiring any manual labor.

Various additional alterations and changes beyond those already mentioned herein can be made to the above-described embodiments. This disclosure is presented for illustrative purposes and should not be interpreted as an exhaustive description of all embodiments or to limit the scope of the claims to the specific elements illustrated or described in connection with these embodiments. For example, and without limitation, any individual element(s) of the described embodiments may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Any reference to claim elements in the singular, for example, using the articles "a," "an," "the" or "said," is not to be construed as limiting the element to the singular.

What is claimed is:

1. A person support apparatus comprising:

a frame;

a seat supported on the frame;

a backrest pivotable between an upright position and a reclined position; and a link assembly coupled to the seat and the backrest, the link assembly configured to continuously move an instantaneous center of rotation of the backrest as the backrest pivots between the upright position and the reclined position.

2. The person support apparatus of claim 1 wherein the instantaneous center of rotation is located at a first position when the backrest is in the upright position and the instantaneous center of rotation is located at a second position when the backrest is in the reclined position, the first position being located forward of the second position.

3. The person support apparatus of claim 2 wherein the first and second positions are both located at a height less than a top surface of the seat.

4. The person support apparatus of claim 3 wherein a displacement between the first position and the second position has a front-back component and an up-down component, and a magnitude of the front-back component is greater than a magnitude of the up-down component.

5. The person support apparatus of claim 3 wherein the link assembly is configured to move the instantaneous center of rotation along a path between the first and second positions that remains at all times below the height of the top surface of the seat.

6. The person support apparatus of claim 2 wherein the link assembly is configured to move the instantaneous center of rotation along a path that is defined by a mathematical spline.

7. The person support apparatus of claim 1 wherein the link assembly includes a right midlink and a left midlink, the right midlink pivotably coupled to the backrest at a back end of the right midlink and pivotably coupled to the seat at a front end of the right midlink, and the left midlink pivotably coupled to the backrest at a back end of the left midlink and pivotably coupled to the seat at a front end of the left midlink.

8. The person support apparatus of claim 7 further including a cross bar rigidly coupled to the right and left midlinks.

9. The person support apparatus of claim 1 wherein the seat includes a seat pan pivotably mounted to a seat frame, the seat frame having a right side plate and a left side plate coupled together by a cross bar, the right side plate including a right slot defined therein and the left side plate including a left slot defined therein.

10. The person support apparatus of claim 9 further including a right pin inserted into the right slot and a left pin inserted into the left slot, the right pin coupled to a right side of the backrest and the left pin coupled to a left side of the backrest.

11. The person support apparatus of claim 10 wherein the right and left slots both define an identical shape, and the shape has a curvature between opposite ends of the slots that can be plotted as a mathematical function having a continuous first derivative.

12. The person support apparatus of claim 11 wherein the mathematical function has a continuous second derivative.

13. The person support apparatus of claim 1 wherein the backrest contains no direct links to the frame, and the seat is pivotably mounted to the frame.

14. The person support apparatus of claim 7 wherein the right midlink and the left midlink each include a front aperture for receiving a pin coupled to a seat frame, the right and left midlinks each having a thickness that is at least as large as a diameter of the pin.

15. The person support apparatus of claim 2 wherein the instantaneous center of rotation does not stay stationary during the pivoting of the backrest between the upright position and the reclined position.

16. The person support apparatus of claim 15 wherein the upright position is substantially vertical and the reclined position is substantially horizontal.

17. A person support apparatus comprising:

a frame;

a seat supported on the frame;

a backrest pivotable between an upright position and a reclined position; and a right midlink having a front end and a back end, the front end pivotably coupled to the seat and the back end pivotably coupled to the backrest;

a left midlink having a front end and a back end, the front end pivotably coupled to the seat and the back end pivotably coupled to the backrest; and a cross bar rigidly coupled to the right and left midlinks.

18. The person support apparatus of claim 17 wherein the seat is pivotably supported on the frame and the cross bar pivots with respect to the frame when the seat pivots with respect to the frame.

19. The person support apparatus of claim 17 wherein the seat includes a seat pan pivotably mounted to a seat frame, the seat frame having a right side plate and a left side plate coupled together by a pair of cross bars, the right side plate including a right slot defined therein and the left side plate including a left slot defined therein.

20. The person support apparatus of claim 19 further including a right pin inserted into the right slot and a left pin inserted into the left slot, the right pin coupled to a right side of the backrest and the left pin coupled to a left side of the backrest.

21. The person support apparatus of claim 20 wherein the right and left slots both define an identical shape, and the shape has a curvature between opposite ends of the slots that can be plotted as a mathematical function having a continuous first derivative.

22. The person support apparatus of claim 21 wherein the right and left midlinks, the right and left pins, and the right and left slots are collectively configured to continuously move an instantaneous center of rotation of the backrest as the backrest pivots between the upright position and the reclined position.

23. The person support apparatus of claim 22 further including an electric actuator having a first end coupled to the backrest and a second end coupled to the seat frame.

24. The person support apparatus of claim 19 wherein the seat pan is supported on the seat frame by a plurality of load cells configured to detect a magnitude of weight supported by the seat pan.

* * * * *